US006483035B2

(12) United States Patent
Hasegawa et al.

(10) Patent No.: US 6,483,035 B2
(45) Date of Patent: Nov. 19, 2002

(54) PROTECTING CONFIGURATION FOR FLAT CABLES

(75) Inventors: Teruaki Hasegawa, Yokkaichi (JP); Hideshi Tachi, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/739,958

(22) Filed: Dec. 20, 2000

(65) Prior Publication Data

US 2002/0092666 A1 Jul. 18, 2002

(30) Foreign Application Priority Data

Jan. 11, 2000 (JP) ..... 2000-002636

(51) Int. Cl.[7] ..... H01R 4/00
(52) U.S. Cl. ..... 174/92; 174/117 F
(58) Field of Search ..... 174/88 R, 82, 174/84 C, 138 F, 117 F, 117 FF; 336/92

(56) References Cited

U.S. PATENT DOCUMENTS 3,960,430 A * 6/1976 Bunnell ..... 174/84 C
4,192,965 A * 3/1980 Baum ..... 174/92 X
4,551,579 A * 11/1985 Takasaki ..... 174/88 R
4,833,775 A * 5/1989 Nager, Jr. ..... 174/88 R X
6,023,022 A * 2/2000 Nakamura et al. ..... 174/88 R
6,160,466 A * 12/2000 Kawai ..... 336/92 X
6,346,673 B1 * 2/2002 Onizuka ..... 174/117 F

FOREIGN PATENT DOCUMENTS

| | | |
|---|---|---|
| DE | 199 04 277 | 8/1999 |
| EP | 286 422 | 10/1988 |
| GB | 2244871 | 12/1991 |
| JP | 4-359874 | 12/1992 |

* cited by examiner

*Primary Examiner*—Chau N. Nguyen
(74) *Attorney, Agent, or Firm*—Banner & Witcoff, Ltd.

(57) ABSTRACT

An upper and lower pair of flat cables 10 are provided with cut-away portions 14. The flat cables 10 are crimped at these portions by connecting terminals 20. A pair of half-members 31 that form a protecting member 30 are attached to the flat cables 10 in a manner whereby they clamp them from above and below, thereby surrounding and protecting the connecting portions.

9 Claims, 5 Drawing Sheets

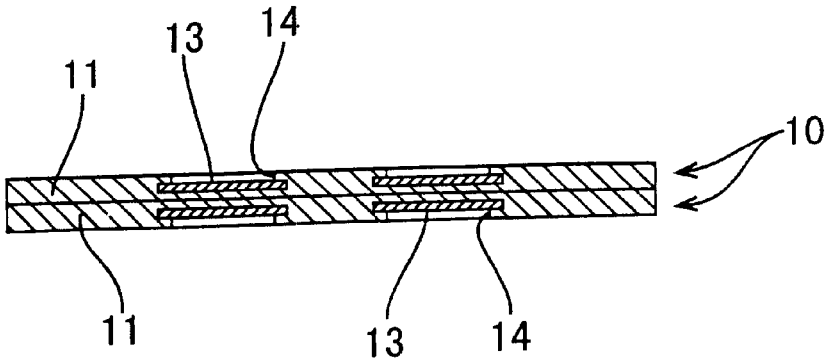
Fig2
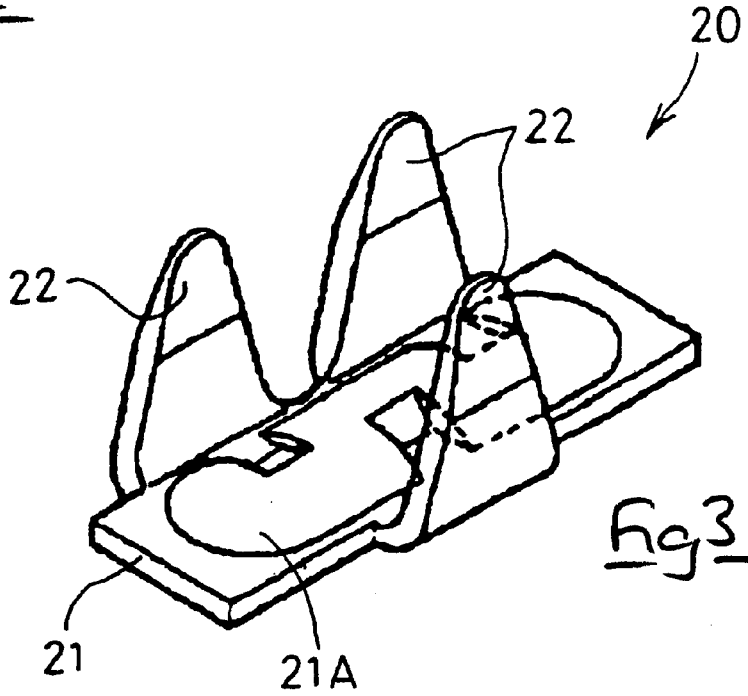
Fig3
Fig4
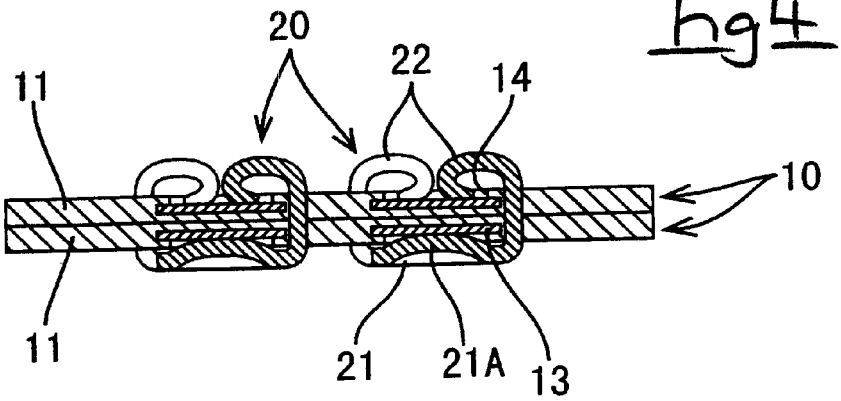

PROTECTING CONFIGURATION FOR FLAT CABLES

TECHNICAL FIELD

The present invention relates to a protecting configuration for flat electrical cables.

BACKGROUND TO THE INVENTION

One example of a conventional FPC flat cable consists of a conductive path formed on an insulating base film, an upper face thereof being covered by a protective film. An example using this type of configuration, wherein conductive paths between a plurality of flat cables are connected, is described in JP 4-359874. In this example, a portion of a film face of a pair of cables is cut away to expose the conductive path within and, with the two flat cables in a state whereby one is above the other, a connecting terminal is used to crimp the exposed portions of the two conductive paths together, thereby connecting the conductive paths via this connecting terminal.

However, in the above example, when the conductive paths between the plurality of flat cables are connected, the conductive paths and the connecting terminals are in an exposed state. Consequently, there is the danger that they may come into contact with foreign matter, thereby being damaged, short-circuited if the foreign matter is electrically conductive, etc.

The present invention has taken the above problem into consideration, and aims to present a configuration for protecting connecting portions between a plurality of flat cables.

SUMMARY OF THE INVENTION

According to the invention there is provided an enclosure for protecting an electrical connection between overlying flat electrical cables each having of a non-conductive flexible carrier strip and a conductive path, said enclosure being adapted to surround said electrical connection and to grip said cables.

Such an enclosure both protects the electrical connection, for example a clamp-type terminal, and grips the cables so as to prevent stretching or twisting forces being transmitted to the connection.

Preferably protrusions of the enclosure pass through preformed apertures of the cable so as to fix the relative position of cable and connector and to ensure effective transmission of forces from one side of the connection to the other.

The enclosure is preferably formed from identical half-members, and has a releasable latch to hold the half-members together. The latch is preferably a snap fit.

The enclosure preferably seals against the flexible carrier strip between adjacent conductive paths so as to provide an insulating and moisture barrier.

BRIEF DESCRIPTION OF THE DRAWINGS

Other features of the invention are disclosed in the following description of a preferred embodiment shown by way of example only in the accompanying drawings in which:

FIG. 2 is a cross-sectional view showing the flat cable.

FIG. 3 is a diagonal view showing a connecting terminal.

FIG. 4 is a cross-sectional view showing the flat cables being connected by the connecting terminals.

DESCRIPTION OF PREFERRED EMBODIMENT

An embodiment of the present invention is described below with the aid of FIGS. 1 to 8.

Figure 1:
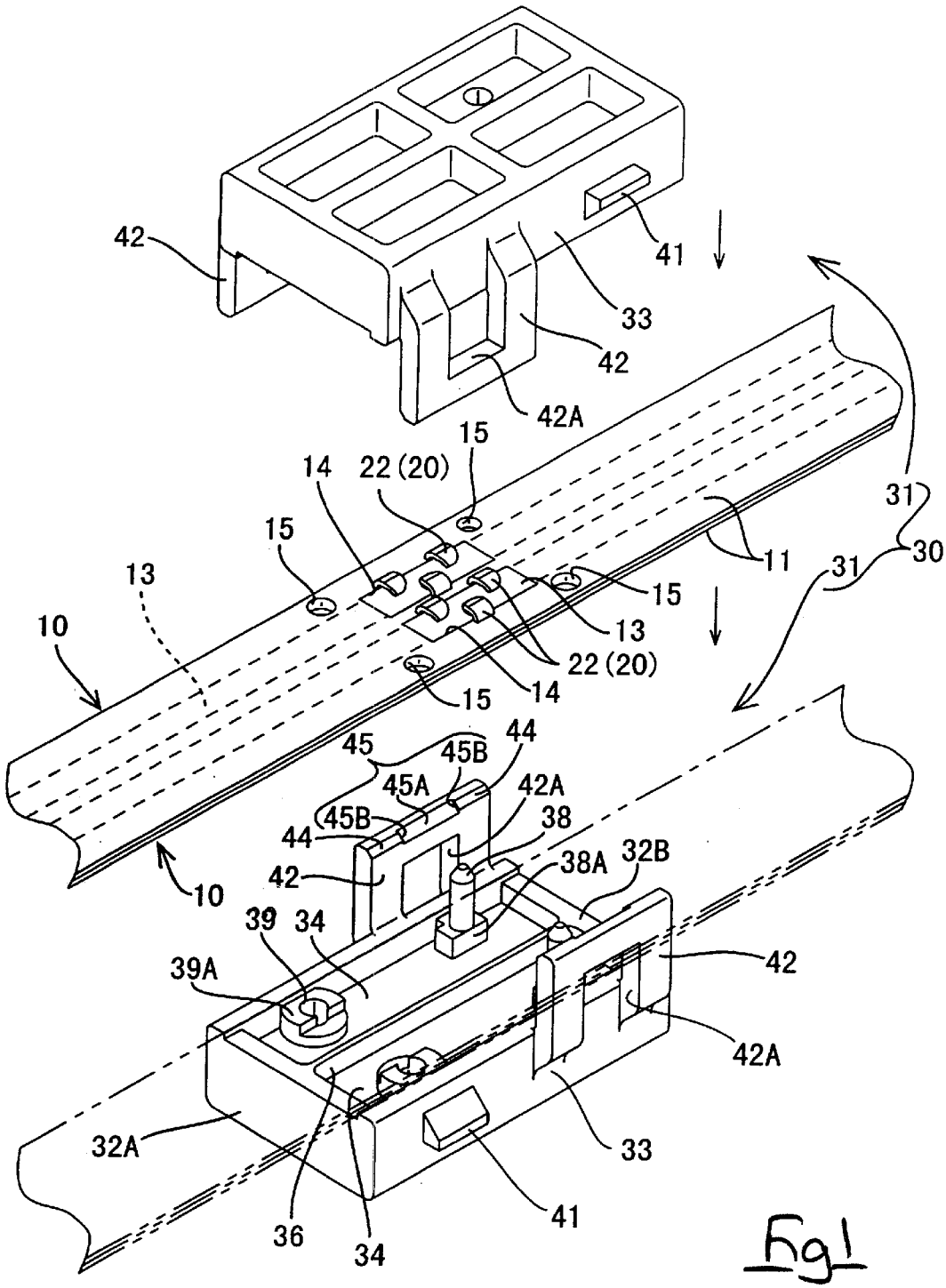
FIG. 1 is a diagonal view showing a protecting configuration for a flat cable of the present embodiment in a state prior to being joined.
Figure 5:
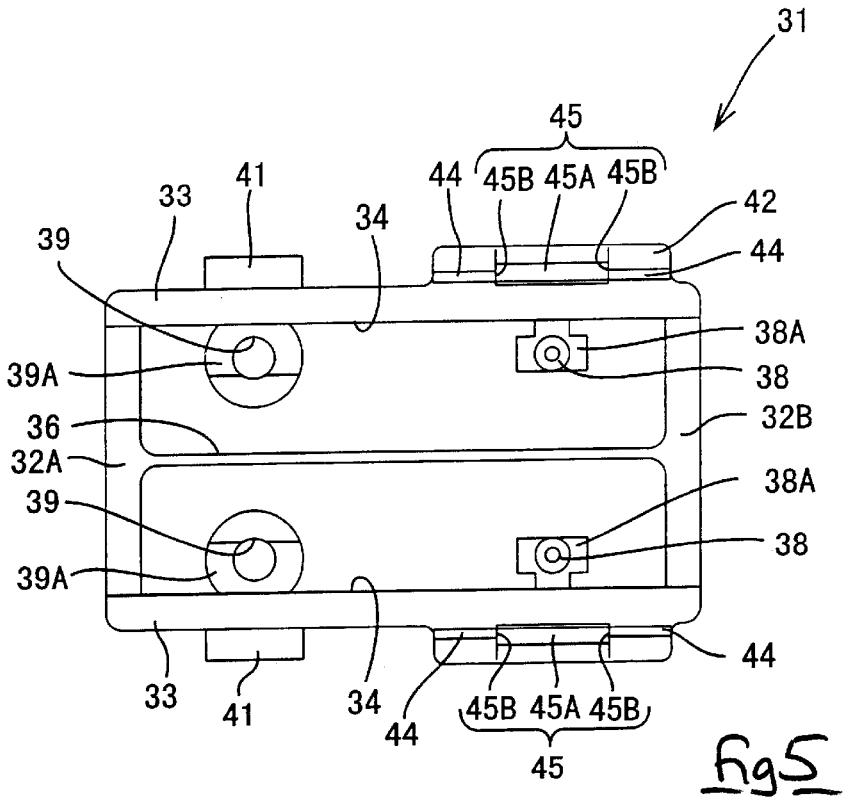
FIG. 5 is a plan view of a half-member.
Figure 6:
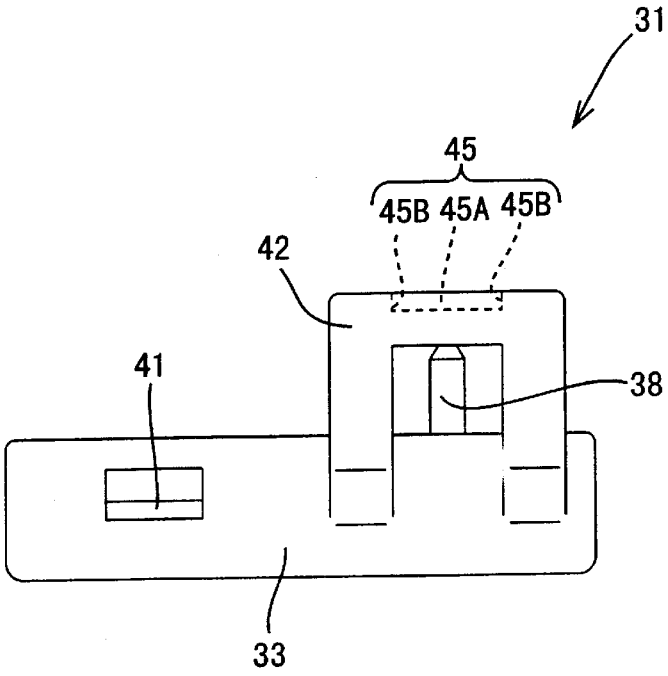
FIG. 6 is a side face view of the half-member.
Figure 7:
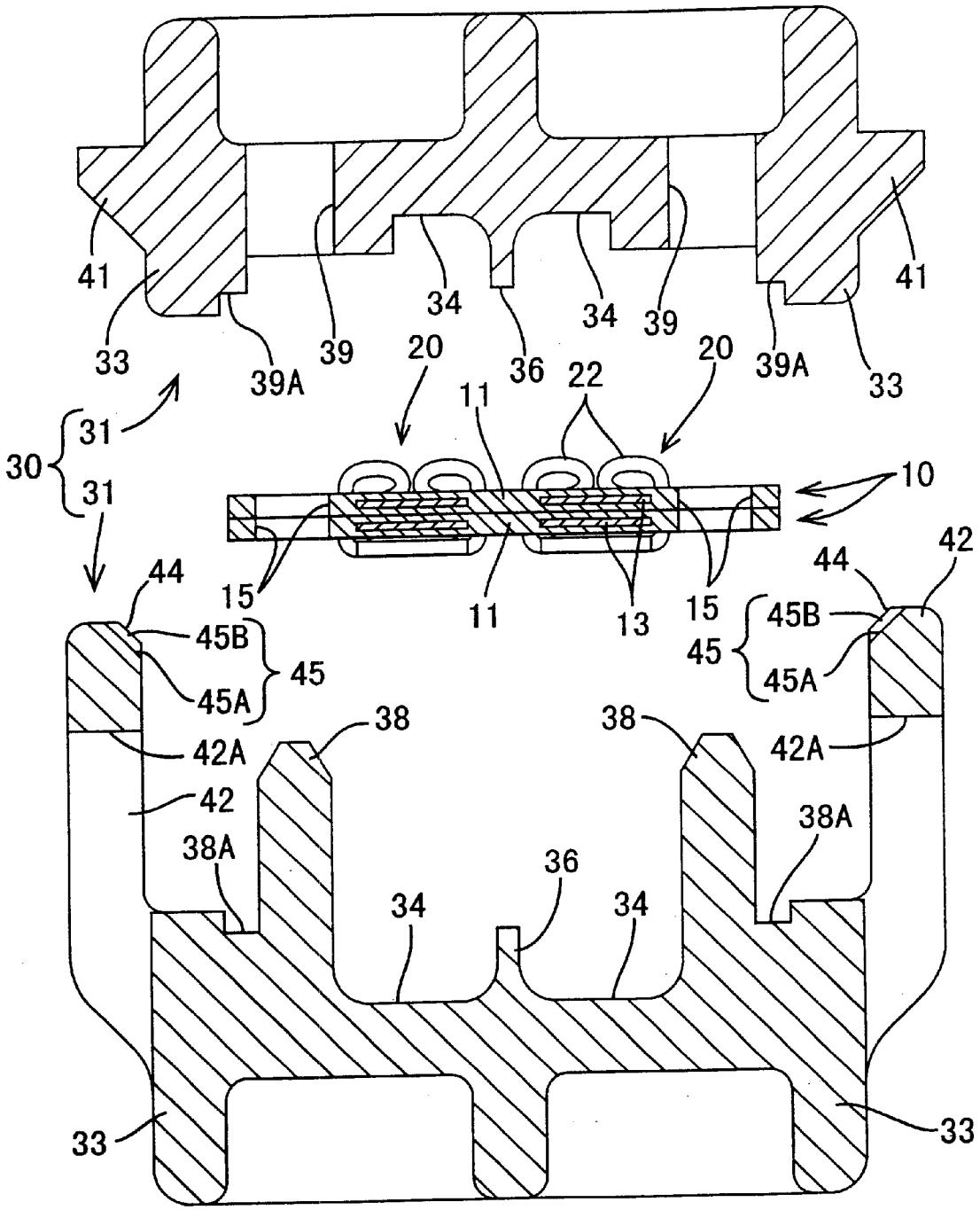
FIG. 7 is a cross-sectional view showing the protecting configuration for a flat cable in a state prior to being joined.
Figure 8:
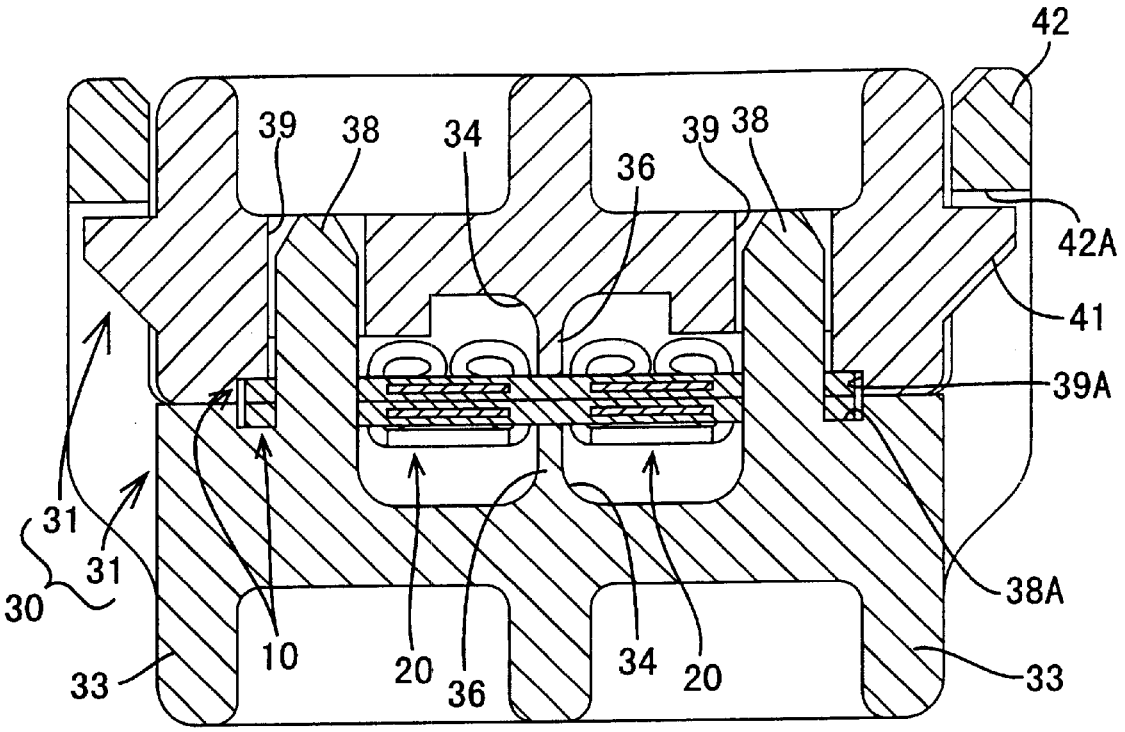
FIG. 8 is a cross-sectional view showing the protecting configuration for a flat cable in a joined state.

As shown in FIG. 1, a configuration for protecting flat cables of the present embodiment consists of an upper and lower pair of flat cables 10, a pair of connecting terminals 20 that are crimped to the two flat cables 10, and a protecting member 30 formed from a pair of half-members 31 that are joined together and attached to the two flat cables 10.

The flat cables 10 consist of a conductive path, composed of a metal film such as copper foil, printed in a specified circuit pattern on the surface of a plastic base film, the exposed surface thereof then being covered with a protective film. Each of the two flat cables 10 is provided with a pair of conductive paths 13 provided longitudinally within ribbon-shaped film 11, the two flat cables 20 being provided one above the other. As shown in FIG. 2, each of the two flat cables has a pair of cut-away portions 14 that have been cut away in a rectangular shape from an outer face side of the film 11. The conductive paths 13 at the interior of the flat cables 10 are exposed from these cut-away portions 14. Connecting terminals 20 (to be explained) are crimped to these exposed portions. As shown in FIG. 1, four circular position fixing holes 15 pass through the film 11 around the periphery of the cut-away portions 14. These position fixing holes 15 are provided so as to have the cut-away portions 14 located therebetween in the length-wise and width-wise directions of the flat cables 10.

Each connecting terminal 20 is formed from conductive metal. As shown in FIG. 3, it has a rectangular base member 21 provided with a protrusion 21 A on its upper face, and claws 22 that have tapering tips. One side edge of the base member 21 has one claw 22 protruding therefrom, the other side has two claws 22 protruding therefrom. In order to connect the connecting terminal 20 with the conductive paths 13, the conductive path 13 of each cut-away portion 14 is positioned between the left and right claws 22 which are then made to pierce the film 11 from below. The tips of the claws 22 are then bent inwards so that they crimp the conductive path 13 within each cut-away portion 14 from above and below (see FIG. 4). By this means, the tips of the claws 22 make contact with the upper conductive paths 13, and the protrusions 21A make contact with the lower conductive paths 13, thereby electrically connecting the upper and lower conductive paths 13 via these connecting terminals 20.

The protecting member 30 is formed from the pair of identically shaped half-members 31 that are joined together (see FIG. 1 and FIGS. 5 to 7). The half-members 31 are made from plastic and form a box shape. In the description of the half-members 31 that follows, for the sake of convenience, the side that is attached to the flat cable 10 is designated the upper side (see the lower half-member 31 in FIG. 1), the width-wise direction of the flat cable 10 is designated the left-right direction, and the length-wise direction of the flat cable 10 is designated the anterior-posterior direction. (The closer side in FIG. 1 is designated the anterior side.)

Each half-member 31 is provided with an anterior face wall 32A, a posterior face wall 32B, and left and right side walls 33. Upper edges of the left and right side walls 33 protrude slightly above an upper face of the half-member 31, and one of the two flat cables 10 can be fitted therebetween in an anterior-posterior direction. A pair of left and right grooves 34 are formed in the upper face of the half-member 31, these being divided by a dividing wall 36 that extends in the anterior-posterior direction. A pin-shaped position fixing protrusion 38 protrudes upwards from a posterior portion of each groove 14, a base end of each position fixing protrusion 38 forming a pressing member 38A that has a flat upper face. The position fixing protrusions 38 are located in positions corresponding to the position fixing holes 15 of the flat cable 10, and can be fitted tightly therein. Pin receiving holes 39 open into anterior portions of the grooves 34, the position fixing protrusions 38 of the corresponding half-member 31 being fitted therein. The circumference of the pin receiving holes 39 form pressing members 39A that are provided with flat upper faces. The upper faces of the pressing members 38A and 39A, the upper edge faces of the anterior face wall 32A and posterior face wall 32B, and an upper edge face of the dividing wall 36 are all the same height. Consequently, as will be explained later, the pair of flat cables 10 can be clamped between these components and the components of the corresponding half-member 31.

A pair of locking protrusions 41 protrude sideways from faces of the left and right side walls 33 at the anterior of the half-member 31. These locking protrusions 41 are cross-sectionally wedge-shaped. A pair of locking members 42 protrude downwards from faces of the left and right side walls 33 at the posterior of the half-member 31. These locking members 42 are U-shaped and are capable of bending outwards. A locking hole 42A opens into the centre of each locking member 42, a corresponding locking protrusion 41 being inserted tightly therein in an anterior-posterior direction, and the two mutually engaging. An anterior and posterior pair of tapered faces 44 are formed on tips of the locking members 42, these tapered faces 44 being inclined inwards. A guiding groove 45 is provided in a stepped shape between the anterior and posterior pair of tapered faces 44. This guiding groove 45 is provided with an inwardly inclined tapered face 45A. The dimensions of these guiding grooves 45, between their anterior and posterior ends 45B, is slightly greater than the width of the locking protrusions 41. As will be explained later, the locking protrusions 41 are inserted into the guiding grooves 45, thereby fixing the position of the two half-members 31 in an anterior-posterior direction at a location where the locking protrusions 41 and the locking members 42 fit together.

The present embodiment is configured as described above. Next, the operation thereof is described.

In order to attach the protecting member 30 to the upper and lower flat cables 10 that have been crimped by the pair of connecting terminals 20, the position fixing protrusions 38 of the first half-member 31 are first inserted into the corresponding position fixing holes 15, and the flat cable 10 is brought to rest over the upper face of the half-member 31 (shown by the two-dot chain line in FIG. 1).

Next, as shown in FIG. 1, the second half-member 31 is brought close to the first half-member 31 in a manner whereby the second half-member is laterally reversed relative to the first. Then the tapered faces 44 of the tips of the locking members 42 guide the first half-member 31 between the two locking members 42 of the second half-member 31. The two half-members 31 are brought closer together, and the locking protrusions 41 of the second half-member 31 make contact with the tips of the locking members 42. Then the two half-members 31 are pressed against one another while being slid in an anterior-posterior direction, and the locking protrusions 41 enter the corresponding guiding grooves 45. By this means, the two half-members 31 reach a state whereby their position relative to one another is fixed in the anterior-posterior direction. At this juncture, the locking protrusions 41 are in a position whereby they can fit into the corresponding locking holes 42A, and the position fixing protrusions 38 are in a position whereby they can fit into the corresponding pin receiving holes 39. If the two half-members 31 are pressed against one another from this state, the locking protrusions 41 pass along the tapered faces 45A and enter the interior of the corresponding locking members 42. These locking members 42 bend outwards relative to one another, and the position fixing protrusions 38 enter the corresponding pin receiving holes 39. The locking members 42 return to their original position when the locking protrusions 41 reach the locking holes 42A, and the locking protrusions 41 engage with the locking members 42, thereby locking the two half-members 31 in a correct attaching state (see FIG. 8). In this manner, the two half-members 31 that form the protecting member 30 are in an attached state with the flat cables 10.

In this protecting configuration for the flat cables 10, the conductive paths 13 that protrude from the connecting terminals 20 and the cut-away portions 14 are housed within the grooves 34 of the protecting member 30, and the periphery thereof is in a covered state. As a result, foreign matter is prevented from making contact with and thereby damaging the connecting terminals 20 or the conductive paths 13, and any other metallic material is prevented from making contact therewith and causing a short-circuit. Furthermore, the protecting member 30 is attached to the pair of flat cables 10 in a manner whereby is clamps them. Consequently, the two flat cables 10 are maintained in their overlapping state.

Moreover, the position fixing protrusions 38 that are part of the position fixing means are inserted tightly within the position fixing holes 15, thereby fixing the position of the protecting member 30 and the two flat cables 10, relative to one another, in the anterior-posterior and left-right directions. Further, these position fixing means are located in positions whereby they clamp the connecting terminals 20 therebetween relative to the length-wise and width-wise direction of the flat cables 10. If the flat cables 10 are pulled or twisted, for example, this force will be received directly by connecting portions of the flat cables 10, the there is the danger that the connecting terminals 20 may bend and the connection may deteriorate. However, the position fixing means 38 and 15 described above are positioned so as to clamp the connecting terminals 20 in the length-wise direction of the flat cables 10. Consequently, any force (particularly a pulling force) transmitted from any part of the flat cables 10 to the connecting portions is reduced. Furthermore, the position fixing means 38 and 15 are positioned so as to clamp the connecting terminals 20 in the width-wise direction of the flat cables 10 as well. Consequently, any force transmitted to the connecting portions from the flat cables 10 (particularly, any force resulting from twisting the flat cables 10) is reduced The pair of connecting terminals 20 are separated by the dividing wall 36 that is closely attached to the face of the film 11. Consequently, if water or the like should enter the interior of the protecting member 30, this water can be prevented from leaking from one connecting terminal 20 to the other.

The protecting member 30 is formed from the half-members 31 that are identical in shape. Consequently, only one type of component needs to be produced, and costs can be reduced.

The locking protrusions 41 and the locking members 42 are formed on the two half-members 31, and the guiding grooves 45, into which the locking protrusions 41 are inserted, are formed in the tips of the locking members 42. When the two half-members 31 are to be joined together, the locking protrusions 41 make contact with the tips of the locking members 42, and sliding the two half-members 31 in the anterior-posterior direction causes the locking protrusions 41 to enter the guiding grooves 45. By this means, the position (in the anterior-posterior direction) of the two half-members 31 is fixed by the fitting of the locking protrusions 41 and the locking holes 42A. The fitting operation of the locking protrusions 41 and the locking holes 42A is simple, and the joining operation can be performed smoothly.

The present invention is not limited to the embodiments described above. For example, the possibilities described below also lie within the technical range of the present invention.

(1) In the embodiment described above, a pair of flat cables 10 provided with a pair of conductive paths 13 are connected by a pair of connecting terminals 20. However, the present invention may equally well have three or more flat cables, and the number of conductive paths and connecting terminals is not restricted to that in the case described above. Furthermore, the shape of the flat cables and the conductive paths is not limited to the straight line described in the above case.

(2) In the embodiment described above, the two conductive paths 13 are connected by being crimped together by the connecting terminals 20. However, the connecting terminals may equally well have another form in the present invention. They may, for example, by welded.

(3) In the embodiment described above, the position fixing protrusions 38 and the position fixing holes 15 serve as the position fixing means for the film 11 and the protecting member 30. However, in the present invention, the two pressing members 38A and 39A, the anterior face wall 32A, the posterior face wall 32B, or the dividing wall 36 could be considered to be a position fixing means that clamps the upper and lower flat cables 10 between the pair of half-members 31.

(4) In the embodiment described above, the protecting member 30 is formed from the pair of half-members 31 that have the same shape and fit mutually together. However, in the present invention, the protecting member could be formed from a pair of half-components that have mutually differing forms. For example, a locking protrusion could be provided on only one of the half-components, and a locking member could be provided only on the other half-component.

The flat cable may comprise a conductive strip within a somewhat thin tubular bag of insulating material.

What is claimed is:

1. An enclosure for protecting an electrical connection between overlying flat electrical cables each having a non-conductive flexible carrier strip and a conductive path, said enclosure comprising a pair of identical half-members each including latch components, the latch components being connectable such that the half-members surround and enclose said electrical connection and grip said cables, the half-members each having an interior surface composed of an insulative material, the interior surfaces facing each other and overlying the flat cable, wherein each said half-member has at least one position fixing protrusion engageable through said flexible carrier strip.

2. An enclosure according to claim 1 and having an electrical terminal connecting said cables, said enclosure fixing said terminal in the lengthwise direction of said cables.

3. An enclosure according to claim 1 wherein said latch components comprise a protruding latch member and a recess, the latch member of each said half-member engaging said recess of the other said half-member.

4. An enclosure according to claim 1 wherein the free ends of said protrusions are engageable in corresponding recesses of said enclosure.

5. An enclosure according to claim 4 wherein said protrusions and recesses define abutment surfaces adapted to grip said cables in use.

6. An enclosure for protecting an electrical connection between overlying flat electrical cables each having a non-conductive flexible carrier strip and a conductive path, said enclosure comprising a pair of identical half-members each including latch components, the latch components being connectable such that the half-members surround and enclose said electrical connection and grip said cables, the half-members each having an interior surface composed of an insulative material, the interior surfaces facing each other and overlying the flat cable, wherein each of the electrical cables includes two conductive paths, the half-members when connected together cooperatively define two longitudinal pathways, each pathway receiving one of the two conductive paths of each flat electrical cable, and each pathway being separated by a dividing wall adapted to tightly engage a flexible carrier strip between said conductive paths.

7. An enclosure for protecting an electrical connection between overlying flat electrical cables each having a non-conductive flexible carrier strip and a conductive path, said enclosure comprising a pair of identical half-members each including latch components, the latch components being connectable such that the half-members surround and enclose said electrical connection and grip said cables, the half-members each having an interior surface composed of an insulative material, the interior surfaces facing each other and overlying the flat cable, wherein each of the electrical cables includes two conductive paths, the half-members when connected together cooperatively define two longitudinal pathways, each pathway receiving one of the two conductive paths of each flat electrical cable, and each pathway being separated by a dividing wall adapted to tightly engage a flexible carrier strip between said conductive paths.

8. An enclosure for protecting an electrical connection between overlying flat electrical cables each having a non-conductive flexible carrier strip and a conductive path, said enclosure comprising a pair of identical half-members each including latch components, the latch components being connectable such that the half-members surround and enclose said electrical connection and grip said cables, the half-members each having an interior surface composed of an insulative material, the interior surfaces facing each other and overlying the flat cable, wherein said latch components comprise a protruding latch member and a recess, the latch member of each said half-member engaging said recess of the other said half-member, and wherein said recess is defined by a resilient 'U' shaped projection.

9. An enclosure for protecting an electrical connection between overlying flat electrical cables each having a non-conductive flexible carrier strip and a conductive path, said enclosure being adapted to surround said electrical connection and to grip said cables and comprising a pair of identical half-members adapted to engage the flat electrical cables on the flat surfaces thereof and having a latch to retain the half-members together, wherein said latch comprises a protruding latch member of one of said half-members, and a recess of the other of said half-members engageable with said latch member, wherein said recess is defined by a resilient 'U' shaped projection of said other half-member, and wherein the outermost portion of each said projection defines a groove adapted to receive and guide said latch member to said recess.

* * * * *